United States Patent [19]

Hollenberg et al.

[11] Patent Number: 5,035,251

[45] **Date of Patent: * Jul. 30, 1991**

[54] HAIR TREATMENT MEDIA APPLICATION DEVICE

[75] Inventors: Detlef Hollenberg, Hilden; Hans Schneider, Schwalmtal; Georg Weihrauch, Wald-Michelbach, all of Fed. Rep. of Germany

[73] Assignee: Henkel Kommanditgesellschft auf Aktien, Duesseldorf, Fed. Rep. of Germany

[ * ] Notice: The portion of the term of this patent subsequent to Nov. 21, 2006 has been disclaimed.

[21] Appl. No.: 148,411

[22] Filed: Jan. 26, 1988

[30] Foreign Application Priority Data

Jan. 26, 1987 [DE] Fed. Rep. of Germany ..... 3702165

[51] Int. Cl.[5] ..... A45D 24/22

[52] U.S. Cl. ..... 132/112; 132/212; 401/190; 401/183

[58] Field of Search ..... 132/112, 113, 114, 115, 132/116, 212, 320; 401/190, 183

[56] References Cited

U.S. PATENT DOCUMENTS

| | | | |
|---|---|---|---|
| 2,672,875 | 3/1954 | Kovacs | 132/112 |
| 3,204,644 | 9/1965 | McDougall-Kaley | 132/212 |
| 4,044,724 | 8/1977 | Merchill | 132/112 |
| 4,209,027 | 6/1980 | Morganroth | 132/212 |
| 4,273,144 | 6/1981 | Morganroth | 132/320 |
| 4,399,827 | 8/1983 | Fuhs | 132/112 |
| 4,592,376 | 6/1986 | Sigmund et al. | 132/112 |
| 4,881,558 | 11/1989 | Hollenberg et al. | 132/112 |

FOREIGN PATENT DOCUMENTS

| | | | |
|---|---|---|---|
| 0068347 | 1/1983 | European Pat. Off. | 401/207 |
| 2749074 | 11/1977 | Fed. Rep. of Germany . | |
| 7932856 | 2/1980 | Fed. Rep. of Germany . | |
| 0775900 | 5/1957 | United Kingdom | 401/183 |

*Primary Examiner*—John J. Wilson
*Assistant Examiner*—Adriene B. Lepiane
*Attorney, Agent, or Firm*—Ernest G. Szoke; Wayne C. Jaeschke; Norvell E. Wisdom, Jr..

[57] ABSTRACT

A hair treatment medium application device comprising an applicator head adapted for either fixed or rotatable mounting upon a container, optionally through an adapter, in which a dispensing mouth in the applicator is in fluid communication with the container, and in which the mouth is surrounded by bristles and one or more guide tines.

9 Claims, 4 Drawing Sheets

HAIR TREATMENT MEDIA APPLICATION DEVICE

BACKGROUND OF THE INVENTION

1. Field of the Invention

This invention relates to a device for the self-application of hair treatment media from a hand-held container in which the media is stored. It comprises a fixed or rotatable applicator head mounted on the container and a dispensing mouth at least partially surrounded by bristles and one or more guide tines.

2. Statement of Related Art

In the dyeing or other treatment of hair on the head, it is important to coat the hair regions disposed near the scalp uniformly with the hair-treating medium. An appropriate hair dyeing appliance is described in German patent document 27 49 074. The known hair dyeing device possesses a hollow comb element which consists of a tube with hollow tines inserted radially therein. The tube is connected, subject to interposition of a pressure reducing valve, with the container holding the dyeing medium. Bristles, which project beyond the tines at the end face, i.e. at their free ends, are arranged around each tine.

A hair-dyeing device with a brush supplied by the dyeing medium is disclosed in European patent document 38,024. The brush spine of the known applicator device can be inclined through 45° to the longitudinal axis of the supply container. The applicator device disclosed in this European application possesses a comb separate from the brush supplied by the dyeing medium. Especially when intended for self-application, difficulties are presented when using the above-mentioned devices in uniformly treating the hairs on the top of the head, at the sides of the head and at the rear head region.

Special hair-dyeing devices are also known for the dyeing of individual hair strands of often only a few hairs, such as described in German Utility Model (Gebrauchsmuster-GM) 79 32 856. This appliance possesses a comb-like applicator provided with a channel connected through a hollow comb spine with the interior of the container and two guide or comb tines, which are each arranged parallel to each other and between which, in the region near to the comb spine, is provided an opening communicating with the channel provided therein. To facilitate the application process, the longitudinal axis of each guide tine is arranged substantially perpendicularly to the plane formed by the longitudinal axis of the comb spine and the longitudinal axis of the container. In order to make possible an adapted setting of the tines for lefthanded or righthanded persons, it should be possible to assume two detent positions, each displaced relative to the other through 180° (about the comb spine as axis), each time for both guide tines in common. The known construction however does not permit further adjustment without appreciable demands on the abstracting capability of the operating person, because two mutually inclined rotary couplings might, in a given case, need to be reset at the same time.

In the comb part known from the above utility model, bristles combined with the guide tines are not provided. Rather, it is proposed to subdivide the guide tines for the finer division of the hair strands respectively to be treated so that three or more tines arranged parallel to each other are present.

BRIEF DESCRIPTION OF THE INVENTION

Other than in the operating examples, or where otherwise indicated, all numbers expressing quantities of ingredients or reaction conditions used herein are to be understood as modified in all instances by the term "about".

This invention is based on the task of creating a hair treating system which puts the user in the position with maximum effect to treat as little hair as possible and which also in the case of self application permits a uniform delivery of the hair treating medium as well as a facilitated manipulation at all sides of the head inclusive of the rear head region. For a hair treating device of the initially discussed kind with a hollow comb spine displaying two guide tines and with an exit opening at the comb spine between the guide tines, the solution according to the invention comprises placing in the region between the guide tines and immediately around the exit opening, bristles extending substantially parallel to the longitudinal direction of the guide tines. The bristles are placed at the body of the comb spine and the guide tines protrude beyond the free longitudinal ends of the bristles.

Through the inventive placement of the bristles immediately around the media-conducting channel outlet, a medium flow is attained which is substantially independent of the size of the exit opening or of the channel cross-section. This construction secures a uniform delivery of the hair treating medium due to the valve-like braking effect of the bristles. The metering is therefore determined mainly only by the pump (capillary) action of the bristles on application or by pressure exerted on the container, which should then be flexible.

Understood under the term "bristles" are also tufts of bristles. The bristles should end at or before the free longitudinal ends of the guide tines (in the region between the guide tines). Preferably the bristles end before the guide tines, most preferably by a distance of about 2 millimeters. A basic idea of such an arrangement is to let as many hairs as possible stay "natural" and thereby to make application of the treatment medium worth trying even by such persons as have reservations against a complete change of their hair color because of feared hair damage.

In a further inventive embodiment, the comb spine is a component of an applicator head which may be mounted rotatably or fixedly on a container at the mouth thereof and which is tapered in the direction toward the guide tines. The applicator head can be added to a product package as a plug or the like. Basically, an applicator system according to the invention with guide tines and bristle crown arranged therebetween, can be placed on the opening of any desired applicator bottle.

When a rotatable applicator head is used in combination with a container, the base of the applicator head should be circular in shape and adjoin a circularly shaped lid surface of the container, which surface preferably is inclined through 45° to the main container vertical axis. At the same time, it can be advantageous to set the rotational axis of the applicator aid into the center normal passing at the same time through the center of the container lid area as well as the base of the applicator aid. In a given case, it is favorable to orient the guide tines inclined through 45° to the rotational axis of the applicator head in such a manner that the longitudinal direction of the guide tines stands parallel to the longitudinal container axis in one rotational setting of the applicator head and perpendicular to the longitudinal container axis in a rotational setting pivoted through 180°. By a rotation through 180° about the rotational axis of the applicator head, the guide tines and thereby the guide slot spanned between them can then be pivoted through 90°, i.e. out of the parallel into the perpendicular (and conversely), to the main axis of the container serving as appliance handle.

According to a further embodiment, the applicator head may have substantially the shape of an inclined circular cone with its cone tip lying perpendicularly above the cone base circumference with respect to the cone base area and with a cone height equal to the cone base diameter. The guide tines are then disposed in the region of the cone tip which is preferably rounded off for reasons of safety and stability, wherein a slot opening containing the bristles extends between the tines. For convenient and safe usage, and above all to prevent snagging of the hair, it is also important to round off all edges and corners of the guide tines and of the adjoining appliance parts; in particular, all molded edges should be chamfered or rounded.

Due to the compact and rounded arrangement caused by a straight or inclined conical shape, a strand of hairs can be introduced conveniently into the slot between the guide tines which can be guided down to the hair root through reciprocating movement, while not treating adjacent strands, thus achieving a desired highlighting effect if a hair dye is dispensed.

The inventive device may be constructed of any suitable plastic material, optionally with metal components. The nature of the plastic material does not constitute a part of this invention.

In another preferred embodiment, an applicator head constructed as an inclined circular cone, adjoins a circularly shaped lid area of the container, the area being inclined through 45° to the main axis of the container, and the rotational axis of the applicator head lies in the center normal passing at the same time through the center of the container lid area as well as of the cone base. In this manner, a hair treating device is created having a closure which is placed rotatably at an angle of about 45° on the oval container body of elliptical shape at least adjoining the container mouth. The exit opening disposed between the guide tines at the base of the opening slot can be rotated through an angle of about 90° relative to the main container axis so that the respectively most favorable orientation of the guide tines relative to the main container axis, either steplessly or in detented settings, can be preset during the treatment for each treatment region at the side surfaces, the upper side and the rear side of the head.

Particular mention must be made that the primary purpose of the inventive device is the application of hair dye, coloring, or bleaching agents, particularly hair dye. However, other hair treatment media, such as bleaches, tints, setting lotions, curling or straightening lotions, and the like, may also be utilized.

BRIEF DESCRIPTION OF THE DRAWING

Details of the invention are explained by reference to the accompanying drawing, all figures being related to embodiments of this invention.

DETAILED DESCRIPTION OF THE INVENTION

In the following examples the hair treating device according to the invention is illustrated in different arrangement combined with media containers of different shape. The system according to the invention is however not limited to certain shapes of container or to certain relative angular settings.

Figure 1:
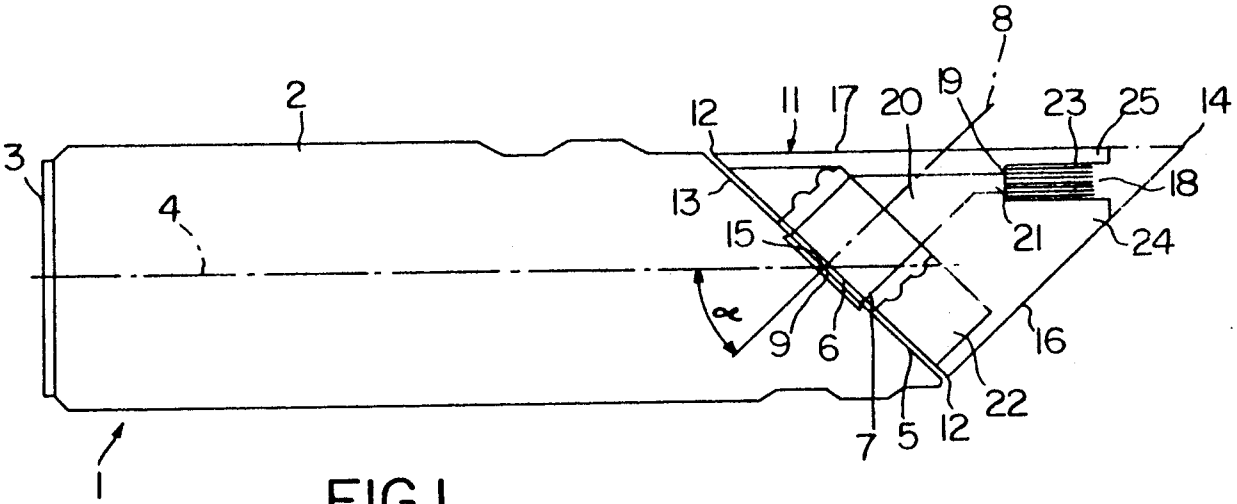
FIG. 1 is a longitudinal section through a hair applicator and container according to the invention.
Figure 2:
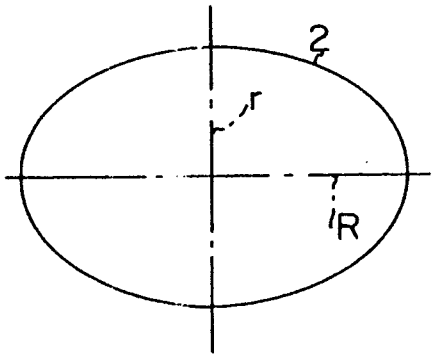
FIG. 2 is a cross section through the container of the device according to FIG. 1.

The hair treating device according to FIGS. 1 and 2 and globally designated by 1 comprises an oval cylindrical container 2 with base 3 and circularly shaped lid area 5 inclined through an angle (a) of 45° to the main vertical axis 4 of the container 2. In the illustrated embodiment, the ratio of the larger elliptical semi-axis R to the smaller elliptical semi-axis r is 1:sin 45°. An exit hole 6 is disposed in the lid area 5. This is surrounded by a nipple 7 on the outside of the lid area 5. The longitudinal axis 8 of the nipple 7 is inclined through an angle (a) of 45° to the main axis 4 of the container body 2.

Figure 3:
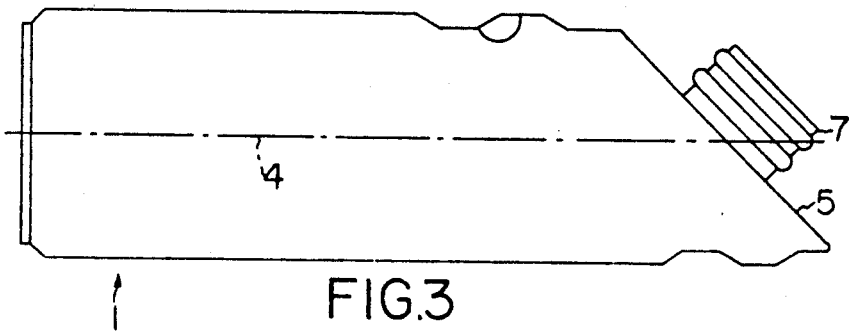
FIG. 3 is an outside view of the container belonging to the hair treating device according to FIG. 1.
Figure 4:
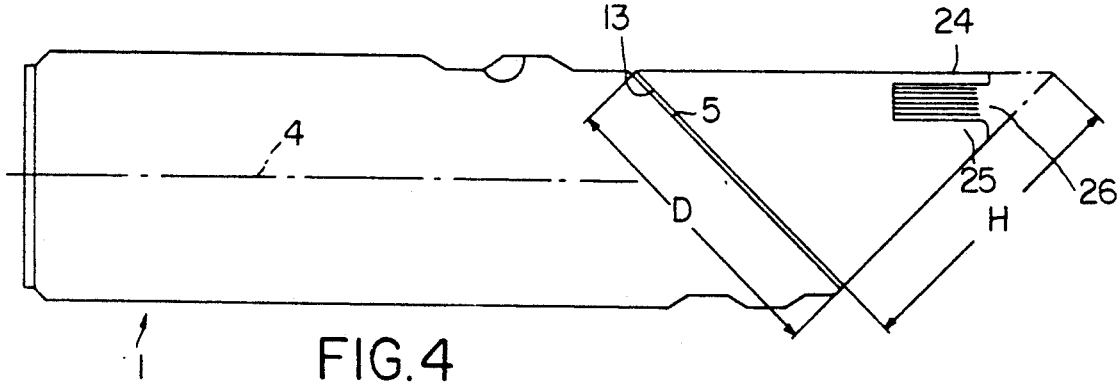
FIG. 4 is an outside view of the entire hair treating device according to FIG. 1.
Figure 5:
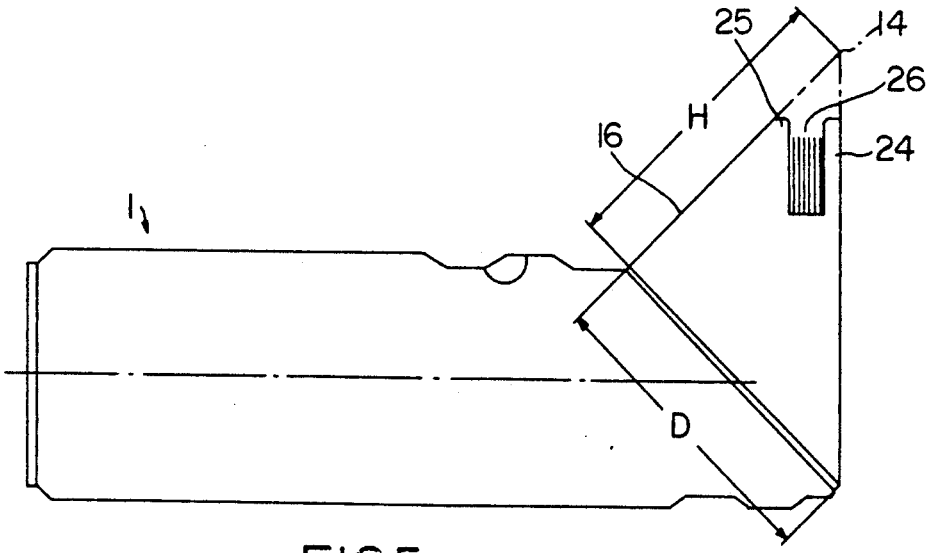
FIG. 5 is an outside view of a hair-treating device according to FIG. 4 with applicator head pivoted through 90°.

The applicator head which is globally designated by 11, in the embodiment according to FIGS. 1 to 5 possesses substantially the shape of an inclined circular cone with a motional cone tip 14 lying perpendicularly above the circumferential line 12 of the cone base 13 and with cone height H being equal to the cone base diameter D (see FIG. 5). The center line passing through the center 9 of the circular lid area 5 of the container 2 coincides with the normal (center line) in the center 15 of the cone base 13 and thereby with the longitudinal axis 8 of the nipple 7. Given the above stated presumptions, the inclined circular cone, describing substantial parts of the surface of the applicator head, according to FIGS. 1 to 5 possesses a shortest generatrix 16 of the length of the height H and a longest generatrix 17 between the cone tip 14 and the cone base circumference 12. For the stated angular and length relationships, the ratio of the length S of the longest generatrix 17 to the length H=D of the shortest generatrix 16 is 1:sin 45°.

The applicator head 11 according to FIGS. 1 to 5 possesses a slot opening 18, which extends parallel to the longest generatrix 17 and perpendicular to the area spanned by the cone base 15 and the longest cone generatrix 17, at the exit opening 19. Communicating between this and the cone base surface 15 is a product channel 20, which preferably has the shape of an inclined hollow cone. The product channel 20 narrows in the direction of a straight outlet channel 21, which extends parallel to the longest cone generatrix 17, up to the exit opening 19. Beyond that, a receiving nipple 22 for the force-locking (click-fit) coupling of the nipple 7 of the container 2 is provided in the interior of the applicator aid 11, so that a locking rotation means is afforded.

External views of a hair treating device 1 are illustrated in FIGS. 3 to 5. In the view according to FIG. 3, the lid area 5, which is inclined through 45° to the vertical axis 4 of the container body 2, yet circularly shaped when viewed perpendicularly, with nipple 7 is illustrated before the applicator head 11 has been placed on it. According to FIG. 4, the applicator head 11 can be so rotated about its longitudinal axis 8 that the longest generatrix 17 forms a straight continuation of the adjoining generatrix of the container body 2 (parallel to the main axis 4 of the container). Two slot surfaces 23 of the guide tines 24 and 25 bound the slot opening 18 and then extend likewise in a direction parallel to the vertical axis 4 of the container 2.

When the applicator head 11 is pivoted through 180° about the axis 8 according to FIG. 5, the slot surfaces 23, bounding the slot opening 18, of the guide tines 24 and 25 are moved into a direction perpendicular to the main axis 4 of the container body 2. In use, the applicator head 11 can through rotation by up to 180° about the axis 8 be pivoted out of the parallel into the perpendicular to the vertical axis 4 of the container 2. Since the container 2 itself forms the handle of the dyeing appliance 1, a convenient manipulation at all places of the head is thus assured on use of the device according to the invention.

A very significant feature of the invention is that the bristles 26, end within the slot opening 18, and thus are shorter than the guide tines 25 and 24. The bristles 26 are arranged around the exit opening 9 in the slot opening 18 remaining between the guide tines 24 and 25. The bristles 26 shall normally, i.e. without loading, stand about parallel to the slot surfaces 23 and to the longitudinal direction of the guide tines 24 and 25. They serve to even out the dye or other media application and to improve the metering.

In the drawing according to FIG. 1, the notional part of the cone tip 14 of the applicator aid 11 is illustrated in dashed lines. As mentioned previously, for reasons of stability and safety, it is adviseable to shorten the cone in this region about transversely to the longest generatrix 17 so that the guide tines 24 and 25 are constructed as walls at both sides of the slot opening 18 affording them a stability adequate for the guidance of the hair to be dyed or otherwise treated.

Figure 6:
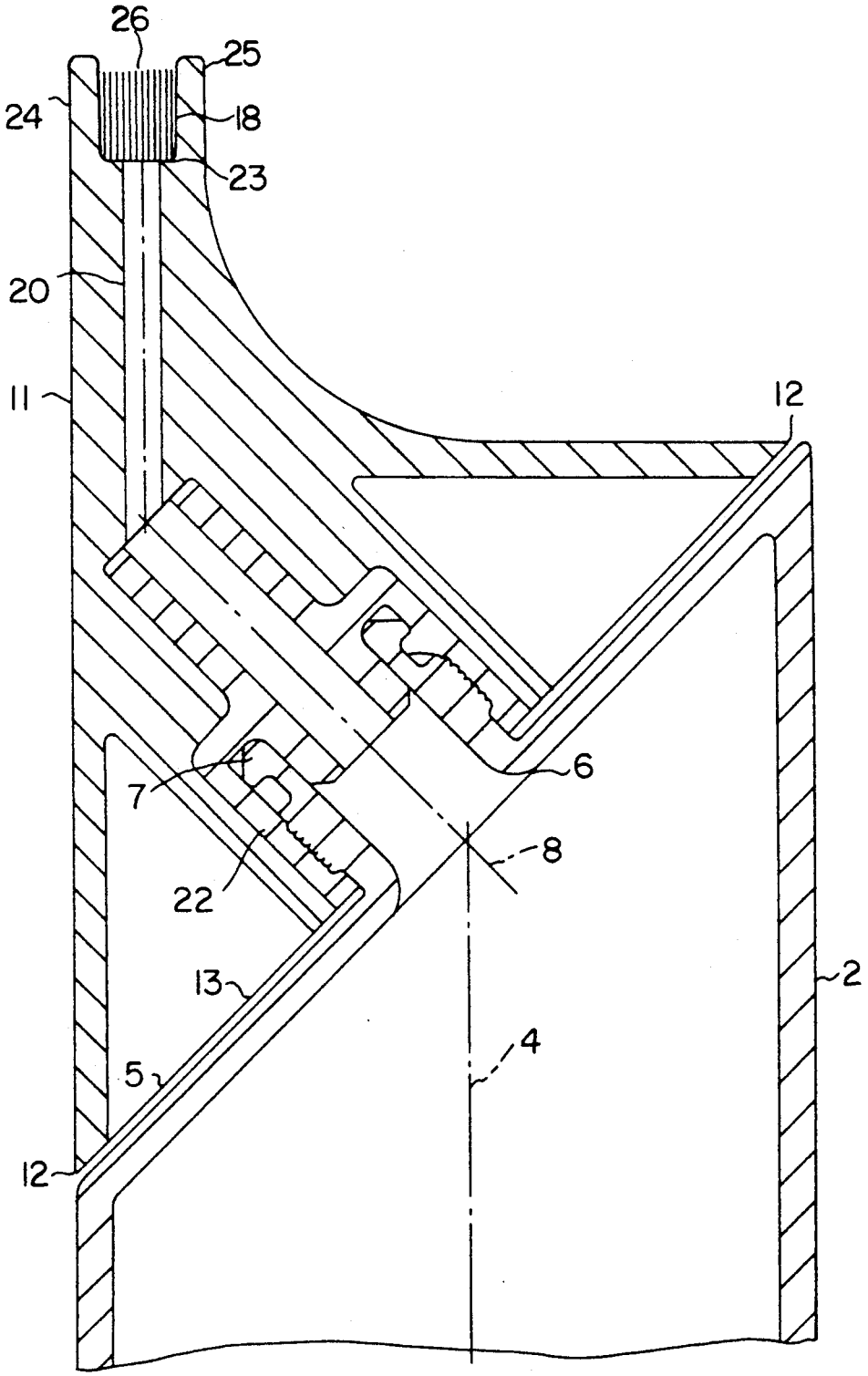
FIG. 6 is a cross section through an embodiment of an applicator head differing from FIG. 1.

FIG. 6 shows an example of an embodiment of an applicator head 11 with a body of about circular cone shape in the lower region and in a certain sense a distally projecting cone tip 14' bent over about parallel to a generatrix. A product channel 20, leading to the interior of the rotatably attached container 2, with exit opening 19 again opens into this cone tip. The exit opening 19 is disposed between both of the guide tines 24 and 25 and is surrounded by bristles 26. Values of about 9 millimeters × 8 millimeters × 12 millimeters have proven useful for the respective length × width × height as dimensions of the guide tines 24 and 25. The width preferably narrows to about 4 millimeters in the upper (outer) third.

In the rotary setting of the applicator head 11 according to FIG. 6, the guide tines 24 and 25 and the slot opening 18 disposed therebetween are evidently oriented about parallel to the main axis 4 of the container 2 and a generatrix, adjoining the applicator head 11, of the container 2. When the applicator head 11 is pivoted through 180° C. about its longitudinal axis 8, the guide tines 24 and 25 are moved out of the parallel setting to the main axis 4 into a setting perpendicular to the main axis 4. The manipulation and the details for the remainder agree substantially with the description of the hair treating device 1 according to FIGS. 1 to 5.

Figure 7:
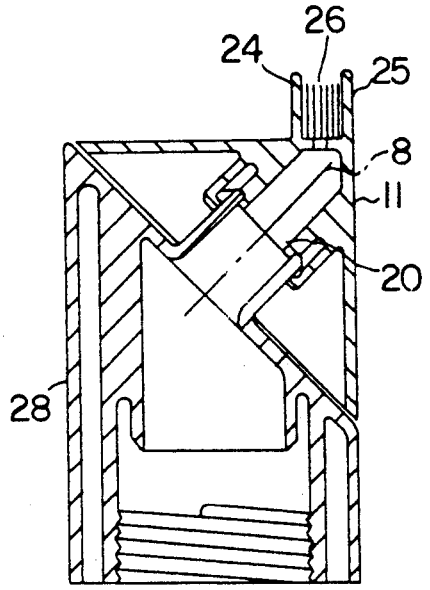
FIG. 7 is a cross section through an applicator head with an adapter.
Figure 10:
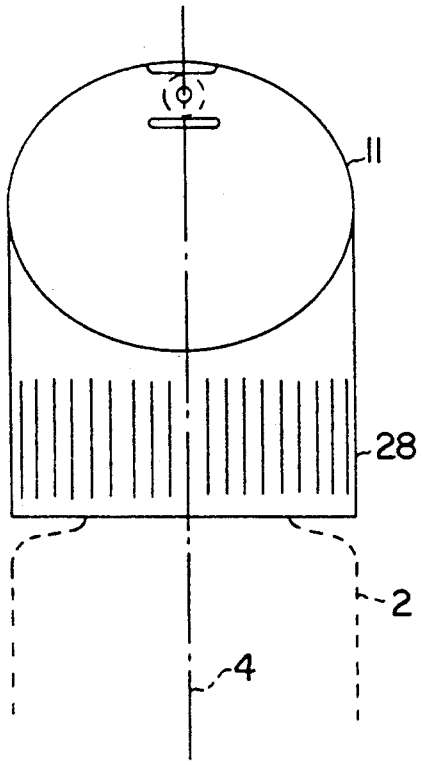
FIG. 10 is an outside view of FIG. 9, seen from the right in the drawing, of the applicator aid according to FIG. 9.
Figure 9:
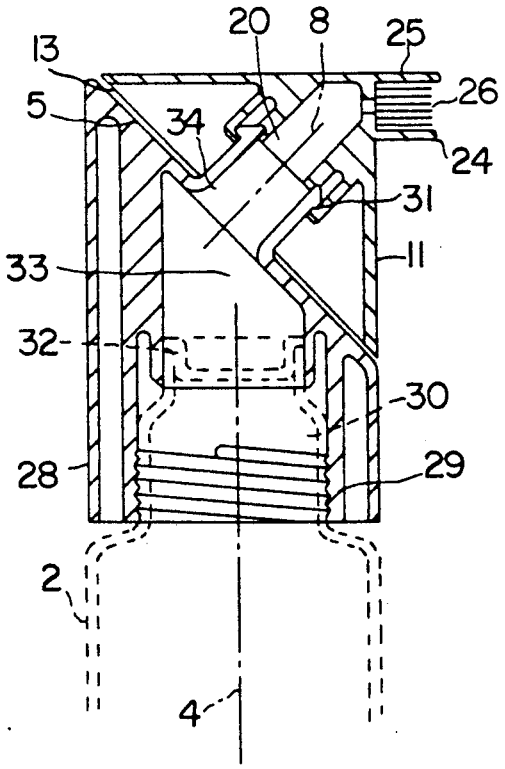
FIG. 9 is a cross section through the applicator head according to FIG. 7 and turned through 90°.

In the embodiment according to FIGS. 7 and 10, an adapter 28 is placed between the applicator head 11 according to the invention and the container 2. It is constructed on its side facing the applicator head substantially just as the container 2 according to FIG. 1 and on its side facing the container 2 can possess a thread 29 for threading onto the mouth 30 of the container 2. The connection between container 2 and adapter 28 can also be structured in different manner, such as a click-fit. It is significant that on the use of the adapter 20, the requirement of elliptical container cross section in the rotational region of the applicator head 11 is removed. Instead, a container 2 of any desired cross section can be used in the embodiment according to FIGS. 7 to 10. The connection means between applicator head 11 and adapter 28 can, for example, be formed by the illustrated impact coupling 31.

The structure according to FIGS. 7 to 10 can, basically just as the hair treating devices according to FIGS. 1 to 6, be equipped with a stopper 32, which after the filling of the container 2 is placed as closure on the mouth 30 thereof. For completion, the adapter 28 with applicator head 11 fastened thereon can then be threaded onto the closed container 2. On application, the consumer screws off the adapter 28 with applicator 11, removes the stopper 32 and sets adapter and applicator head again onto the mouth 30 of the container 2 so that the hair treating device 1 according to the invention is ready for operation. After use of the device, the stopper 32 can again be set as closure onto the mouth 23 in reversed sequence of the manipulations.

Figure 8:
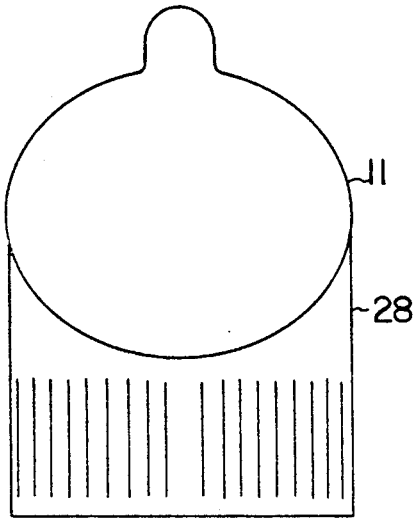
FIG. 8 is an outside view of the applicator head according to FIG. 7.

In still another embodiment (not shown) the invention device may have a non-rotatable (i.e. fixed) applicator head, which is integrally formed with the adapter 28. In such instance, the bristles 26 and tines 24, 25 may be permanently mounted parallel to the container vertical axis 4 and would have the same outward appearance as shown in FIG. 8, as well as in the outline of FIG. 7. While the media flow channel of FIG. 7 could still exist, there would be no need for either a rotation means or opposed faces of the adapter and applicator head, since they would be integrally formed. The internal structure of such a non-rotatable applicator head/adapter combination will be readily apparent to those skilled in the art. Alternatively, the bristle 26/tines 24, 25 arrangement may be permanently perpendicular to the vertical axis 4, in which instance the outward appearance would be the same as in FIG. 10, as well as in the outline of FIG. 9. The foregoing comments regarding the parallel aligned arrangement are otherwise applicable.

We claim:

1. A device for the application of a hair treatment medium, said device comprising:

(A) a container for the hair treatment medium, said container having a top opening and a vertical central axis, said top opening being surrounded by a planar container face and being disposed at a 45° angle to said vertical central axis, said container being adapted to form a handle for the device;

(B) an applicator head rotatably mounted on the container top opening, said applicator head having a media dispensing mouth, an axis of rotation, and a planar base which adjoins said container face when said applicator head is mounted upon said container, so that the axis of rotation of said applicator head intersects the vertical axis of said container approximately in the plane of said container face;

(C) passage means within the applicator head communicating between the dispensing mouth of the applicator head and the interior of the container, so that hair treatment medium may flow from the container, through the applicator head and out its dispensing mouth; and (D) dispensing means located at the dispensing mouth for applying hair treatment medium directly to the hair, said dispensing means comprising a plurality of outwardly projecting bristles surrounding the dispensing mouth, and one or more guide tines adjacent and parallel to the bristles outward from the dispensing mouth, the length of the bristles being not more than the length of the guide tines, said bristles and guide tines being so disposed on said applicator head that as said applicator head is rotated around its axis to the extent permitted by its mounting, said bristles and guide tines assume at one point during the rotation an orientation parallel to the vertical axis of the container and at one other point during the rotation an orientation perpendicular to the vertical axis of the container.

2. The device of claim 1 wherein said applicator head is tapered in the direction of said dispensing means.

3. The device of claim 1 or 2 wherein said bristles and one or more guide tines project outward at a 45° angle relative to the rotational axis of the applicator head.

4. A device for the application of a hair treatment medium, said device comprising:

(A) a container for the hair treatment medium, said container having a top opening and a vertical central axis, said container being adapted to form a handle for the device;

(B) an adapter mounted atop said container, said adapter having a bottom opening communicating with the top opening of said container and a top opening surrounded by a planar face that is disposed at a 45° angle to said vertical central axis of said container;

(C) an applicator head rotatably mounted on the adapter top opening, said applicator head having a media dispensing mouth, an axis of rotation, and a planar base which adjoins said adapter face when said applicator head is mounted upon said adapter, so that the axis of rotation of said applicator head intersects the vertical axis of said container approximately in the plane of said planar face of said adapter;

(D) passage means within the applicator head and the adapter communicating between the dispensing mouth of the applicator head and the interior of the container, so that hair treatment medium may flow from the container, through the adapter and the applicator head and out its dispensing mouth; and (E) dispensing means located at the dispensing mouth for applying hair treatment medium directly to the hair, said dispensing means comprising a plurality of outwardly projecting bristles surrounding the dispensing mouth, and one or more guide tines adjacent and parallel to the bristles outward from the dispensing mouth, the length of the bristles being not more than the length of the guide tines, said bristles and guide tines being so disposed on said applicator head that as said applicator head is rotated around its axis to the extent permitted by its mounting, said bristles and guide tines assume at one point during the rotation an orientation parallel to the vertical axis of the container and at one other point during the rotation an orientation perpendicular to the vertical axis of the container.

5. The device of claim 1 or 4 wherein said applicator head is substantially a distally tapering cone.

6. The device of claim 5 wherein said dispensing means are proximal to the tip of said cone.

7. The device of claim 6 wherein the geometric axis of said cone coincides with the rotational axis of the applicator head.

8. The device of claim 6 wherein the geometric axis of said cone is angular to the rotational axis of the applicator head, and wherein the tip of the cone lies perpendicularly above the circumference line of the cone base, the distance from the tip to the circumference line being equal to the cone diameter.

9. The device of any of claims 1, 2 or 4 wherein said dispensing means comprises two parallel guide tines which project beyond the ends of said bristles.

* * * * *